US005264900A

United States Patent [19]

Momiyama et al.

[11] Patent Number: 5,264,900

[45] Date of Patent: Nov. 23, 1993

[54] DEVELOPING DEVICE INCLUDING TONER HOPPER AND TONER CARTRIDGE STIRRING PORTIONS

[75] Inventors: Yoshiharu Momiyama; Shigeki Nakajima; Yukio Ota, all of Tokyo, Japan

[73] Assignee: Oki Electric Industry Co., Ltd., Tokyo, Japan

[21] Appl. No.: 898,125

[22] Filed: Jun. 12, 1992

[30] Foreign Application Priority Data

Jun. 14, 1991 [JP] Japan ..... 3-044975[U]

[51] Int. Cl.[5] ..... G03G 15/06

[52] U.S. Cl. ..... 355/260; 355/245; 366/279

[58] Field of Search ..... 355/260, 245, 298, 251, 355/253; 118/656, 653; 366/133, 136, 154, 279, 293, 294

[56] References Cited

U.S. PATENT DOCUMENTS

| | | | |
|---|---|---|---|
| Re. 33,484 | 12/1990 | Imanaka | 355/298 |
| 4,274,362 | 6/1981 | Beck et al. | 355/253 X |
| 4,324,483 | 4/1982 | Tagawa et al. | 355/251 X |
| 4,456,364 | 6/1984 | Hatzis | 355/260 |
| 4,477,173 | 10/1984 | Kozuka et al. | 355/260 |
| 4,566,776 | 1/1986 | Kondoh . | |
| 4,711,551 | 12/1987 | Fujio et al. | 355/298 |
| 4,881,103 | 11/1989 | Seto et al. . | |
| 4,894,688 | 1/1990 | Taniguchi et al. | 355/298 |
| 4,937,625 | 6/1990 | Kato et al. | 355/245 |
| 4,943,830 | 7/1990 | Sulenski | 355/245 |
| 4,980,724 | 12/1990 | Tanaka | 355/245 |
| 4,989,539 | 2/1991 | Ichikawa | 118/656 X |
| 5,077,583 | 12/1991 | Bhagat | 355/245 X |
| 5,132,734 | 7/1992 | Momiyama | 355/245 X |

FOREIGN PATENT DOCUMENTS

| | | |
|---|---|---|
| 0374920 | 6/1990 | European Pat. Off. . |
| 0435259 | 7/1991 | European Pat. Off. . |
| 0481085 | 4/1992 | European Pat. Off. . |
| 62-280879 | 12/1987 | Japan . |

*Primary Examiner*—A. T. Grimley
*Assistant Examiner*—Sandra L. Brasé
*Attorney, Agent, or Firm*—Spencer, Frank & Schneider

[57] ABSTRACT

A developing device suitable for use in an electrophotographic recording apparatus includes either a toner stirring portion arranged in a toner hopper portion, the toner stirring portion being provided with a portion for varying toner conveying speed, or in the toner a toner stirring and moving means provided in a toner cartridge. A printing irregularity does not occur on a printing paper even if the printing is performed at the state where the amount of toner, which is collected in the toner hopper portion, is too reduced to sufficiently cover the toner hopper stirring portion.

26 Claims, 16 Drawing Sheets

DEVELOPING DEVICE INCLUDING TONER HOPPER AND TONER CARTRIDGE STIRRING PORTIONS

BACKGROUND OF THE INVENTION

1. Field of the Invention

The present invention relates to a developing device structure employed for an electrophotographic recording apparatus such as a printer, a copier, etc.

2. Description of the Related Art

A developing device of this type is disclosed in the EPC Publication No. 0435259A3 filed by the present applicant.

In this developing device, a toner is supplied from a toner cartridge to a developing portion to be collected in a toner hopper portion, and is stirred by a stirring means provided in the toner hopper portion. Thereafter the toner is supplied to a photoconductor drum via a supply roller and developing roller.

In some electrophotographic recording apparatus, an indicator for positioning the printing paper is set at the central portion of the printing paper in the width direction thereof. Such an electrophotographic recording apparatus has typically a stirring means for the developing device as illustrated in FIG. 20.

A toner hopper stirring means 80 comprises a shaft 19 and helical members 81*a* and 81*b* respectively formed of springs. The helical members 81*a* and 81*b* have the same coil diameters and the same winding pitches. The helical members 81*a* and 81*b* are wound around the shaft in the directions opposite to each other. When the shaft 19 of the toner hopper stirring means 80 is turned in the direction of the arrow C, the toner positioned at both ends of the shaft 19 is stirred and moved toward the central portion of the shaft 19. If the feeding standard of the electrophotographic recording apparatus is set at the central portion of the printing papers, the printing frequency is increased at the central portion of the photoconductor drum when printing is performed on printing papers having different sizes, so that much toner is consumed at the central portion of the toner hopper portion in the developing device but is supplemented with the toner which is moved toward the central portion of the toner hopper portion by the toner hopper stirring means 80.

However, in the conventional developing apparatus, the toner collected in the toner hopper portion is always conveyed by the toner hopper stirring means toward the central portion of the toner hopper portion at a constant speed and supplied to the supply roller of the developing portion.

Accordingly, there is no problem when the amount of toner collected in the toner hopper portion is enough to sufficiently cover the toner hopper portion but there arises the problem that the toner is locally positioned at the central portion of the toner hopper portion and is reduced at both ends of the toner is hopper portion when the amount of toner reduced to such an extent that it does not sufficiently cover the toner hopper stirring portion. If printing is performed in the latter case, there is a problem that a printing irregularity occurs on the printing paper, which deteriorates the printing quality. Especially, if printing few characters on a printing paper continues, the printing quality is remarkably deteriorated.

SUMMARY OF THE INVENTION

It is an object of the present invention to provide a developing device capable of preventing printing irregularity on a printing paper even if the printing is performed at the state where the amount of toner is reduced in the toner hopper portion and the toner cannot sufficiently cover the toner hopper stirring portion.

To achieve the above object, the developing device according to a first aspect of the present invention comprises a developing portion for supplying toner to an electrostatic latent image on a photoconductor drum and developing said latent image; a toner hopper portion for correcting toner therein and supplying the toner to the developing portion; and a stirring portion disposed in the toner hopper portion and composed of a shaft, first and second helical members which are wound on the shaft in the directions opposite to each other wherein the first and second helical members are turned to thereby stir a part of the toner and convey the same toward the central portion of the toner hopper portion, the first and second helical members being formed of coil shaped members, and the first and second helical members being provided with toner conveying speed varying portions for changing the conveying speed of the toner.

The developing device according to a second aspect of the present invention comprises a developing portion for supplying toner to an electrostatic latent image on a photoconductor drum and developing said latent image; a toner hopper portion for collecting toner supplied from a toner cartridge and supplying the toner to the developing portion; the toner cartridge for storing toner therein and supplying the toner to the toner hopper portion; and a toner cartridge mounting portion for mounting the toner cartridge, the toner hopper portion including a toner hopper stirring portion composed of first and second helical members which are wound in the directions opposite to each other, the toner cartridge including a toner cartridge stirring portion composed of third and fourth helical members which are wound in the directions opposite to each other; and a driving means for stirring and conveying toner toward the central portion by turning the first and second helical members of the toner hopper stirring portion and for stirring and conveying toner in the toner hopper stirring portion toward both ends of the toner hopper portion by turning the third and fourth helical members of the toner cartridge stirring portion.

The developing device according to a third aspect of the present invention comprises a photoconductor drum for forming an electrostatic latent image on the peripheral surface thereof by charging with electricity by a charging means and by exposing the same by a light emitting means, a developing portion for supplying toner to the latent image on the outer periphery of the photoconductor drum and developing the latent image; a toner hopper portion for collecting toner therein and for the supplying toner to the developing portion; a toner stirring means composed of a shaft and first and second helical members which are wound around the shaft in the directions opposite to each other; a cleaning means for removing the toner which has not been transferred in a transfer process but remains on the outer periphery of the photoconductor drum; a toner conveying means for conveying the removed toner to the portion close to the end portion of the toner stirring portion wherein the first and second helical members are turned to thereby stir the toner and convey the toner toward the central portion of the toner hopper portion; the first and second helical members being formed of coils, said coils having the same outer diameters and winding pitches, the first and second helical members being respectively provided with toner conveying speed varying portions for changing the conveying speed of the toner.

The developing device according to a fourth aspect of the present invention comprises a photoconductor drum for forming an electrostatic latent image on the peripheral surface thereof by charging with electricity by a charging means and by exposing the same by a light emitting means, a developing portion for supplying toner to the latent image on the outer periphery of the photoconductor drum and developing the latent image; a toner hopper portion for collecting the toner therein and for supplying the toner to the developing portion, a toner stirring means composed of a shaft and first and second helical members which are wound around the shaft in the directions opposite to each other; a toner cartridge portion for storing the toner therein and for supplying the toner to the toner hopper portion, a toner cartridge portion for mounting the toner cartridge; a cleaning means for removing the toner which has not been transferred in a transfer process but remains on the outer periphery of the photoconductor drum; a toner conveying means for conveying the removed toner to the portion close to the end portion of the toner stirring portion wherein the first and second helical members are turned to thereby stir the toner and convey the toner toward the central portion of the toner hopper portion; the first and second helical members being formed of coiled members, said coiled members having the same outer diameters and winding pitches, the toner cartridge including a toner cartridge stirring portion composed of third and fourth helical portions which are wound in the directions opposite to each other, the third and fourth helical members having the same diameters and winding pitches; and a driving means for turning the third and fourth helical members of the toner cartridge stirring means to thereby stir the toner in the toner cartridge and convey the toner toward both ends of the toner cartridge.

DESCRIPTION OF THE PREFERRED EMBODIMENT

First Embodiment (FIGS. 1 to 4)

A developing device according to a first embodiment will be described with reference to FIGS. 1 to 4 in which elements which are common to these figures are denoted at the same numerals.

Figure 1:
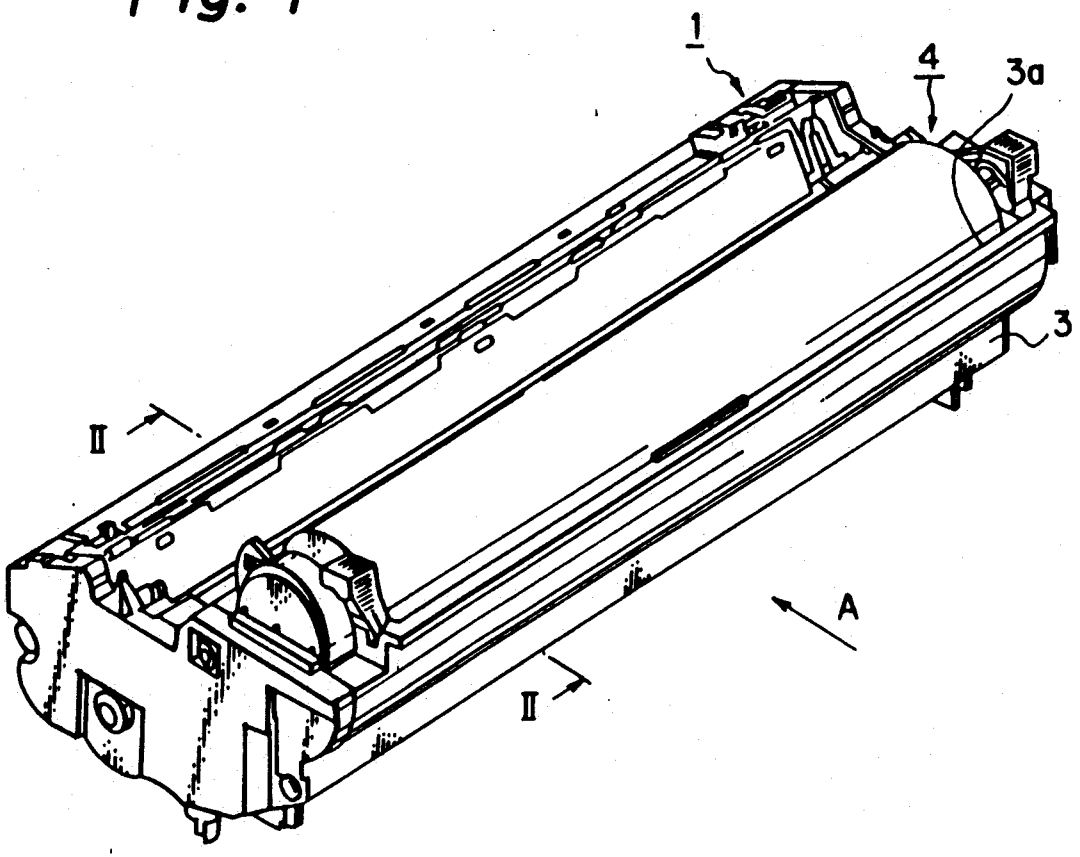
FIG. 1 is a perspective view showing the external appearance of a developing device according to a first embodiment of the present invention.

In FIG. 1 showing the external appearance of the developing device 1, a toner cartridge 4 for storing toner as a one component developer extends in the width direction of a printing paper and mounted on a mounting portion 3*a* of the frame 3 of a developing device 1. The printing paper is fed toward the developing device 1 in the direction of the arrow A.

Figure 2:
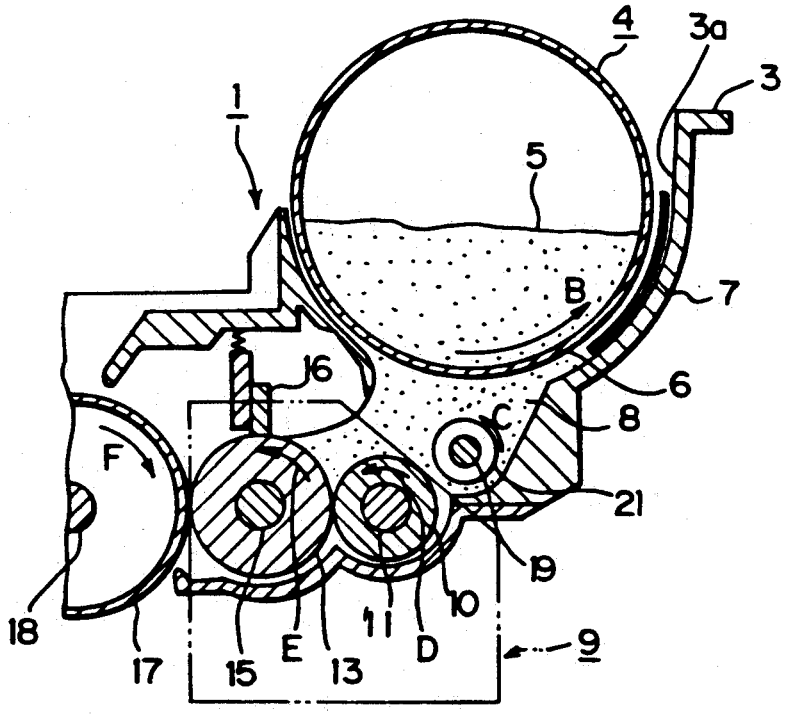
FIG. 2 is a cross-sectional view taken along line II—II in FIG. 1.

In FIG. 2 showing a cross-sectional view taken along the line II—II in FIG. 1, the developing device 1 comprises a toner hopper portion 8 for collecting toner 5 therein, a photoconductor drum 17, and a developing portion 9 for supplying toner 5 on an electrostatic latent image on the photoconductor drum 17 to thereby develop the same. The developing portion 9 comprises a supply roller 10, a developing roller 13, and a developing blade 16.

The toner hopper portion 8 is positioned under the toner cartridge 4 and has a toner hopper stirring portion 21 which is positioned adjacent to the developing portion 9 for stirring the collected toner 5.

Figure 3:
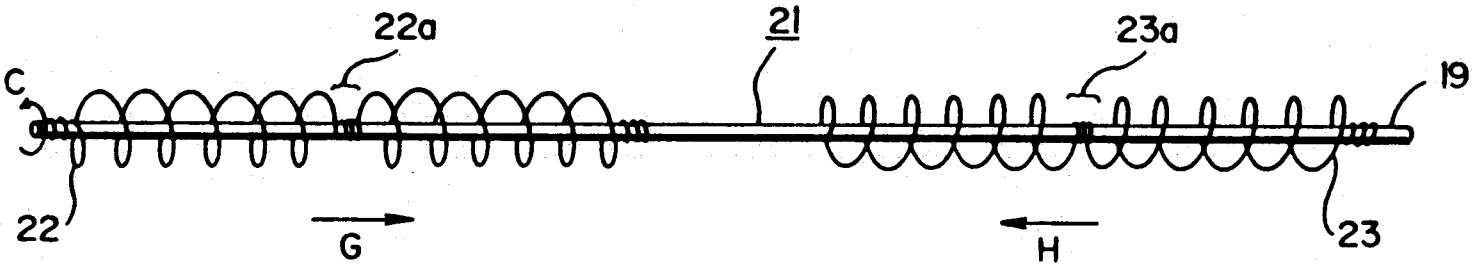
FIG. 3 is a perspective view showing the external appearance of a toner hopper stirring portion of the developing device in FIG. 1.

FIG. 3 shows a perspective view of the external appearance of the toner hopper stirring portion in the developing device 1. The toner hopper stirring portion 21 comprises a shaft 19 and first and second helical members 22 and 23 respectively fixed to the shaft 19 by welding, etc. The first and second helical members 22 and 23 are formed of coil springs by machining a wire such as piano wire.

The first helical member 22 has a toner conveying speed varying portion 22a at the central portion thereof and has coils of the same winding pitches and the same outer diameters at the other portions thereof. At the toner conveying speed varying portion 22a the coil is closely wound around the shaft 19 being in close contact with the shaft 19 at the inner diameter thereof. The toner conveying speed at the toner conveying speed varying portion 22a can be reduced remarkably compared with the toner conveying at other portions of the first helical member 22.

The second helical member 23 is wound on the shaft 19 in the direction opposite to that of a first helical member 22 and is formed by the coil with the same outer diameter. A toner conveying speed varying portion 23a is provided at the central portion of the second helical member 23 in the same way as for the first helical member 22.

When the toner hopper stirring portion 21 rotates the shaft 19 in the direction of the arrow C while stirring the toner, the first helical member 22 conveys toner in the direction of the arrow G and the second helical member 23 conveys toner in the direction of the arrow H.

The operation of the developing device 1 will be described with reference to FIG. 2.

The toner cartridge 4 mounted on the developing device 1 turns a shutter 7 disposed thereunder in the direction of the arrow B to open an opening 6, thereby dropping the toner 5 downward from the opening 6. The dropped toner 5 is collected in the toner hopper portion 8 disposed under the toner cartridge 4.

Toner 5 collected in the toner hopper portion 8 is stirred by the rotation of the toner hopper stirring portion 21. The toner hopper stirring portion 21, the supply roller 10, the developing roller 13 and the photoconductor drum 17 have respectively their shafts 19, 11, 15 and 18 which are respectively turnably supported by the frame 3. Each of the shafts 19, 11, 15 and 18 has one end to which a gear, not shown, is fixed, and these gears mesh with one another to constitute a chain of gears. When the chain of gears are driven, the toner hopper stirring portion 21, the supply roller 10, the developing roller 13 and the photoconductor drum 17 are synchronously rotated in the directions of the arrows C, D, E and F.

The toner 5 supplied from the toner hopper portion 8 to the supply roller 10 is supplied to the developing roller 13 by turning of the supply roller 10 in the direction of the arrow D. The toner 5 thus supplied to the developing roller 13 is brought into close contact with the developing blade 16 by the turning of the developing roller 13 in the direction of the arrow E, whereby a thin toner layer is formed on the surface of the developing roller 13. The thin layered toner 5 is supplied to the electrostatic latent image on the surface of the photoconductor drum 17 to develop the latent image.

The stirring operation of the toner hopper stirring portion 21 will be described hereinafter with reference to FIG. 4 which shows the state where toner is circulated in the toner hopper stirring portion 21.

Figure 4:
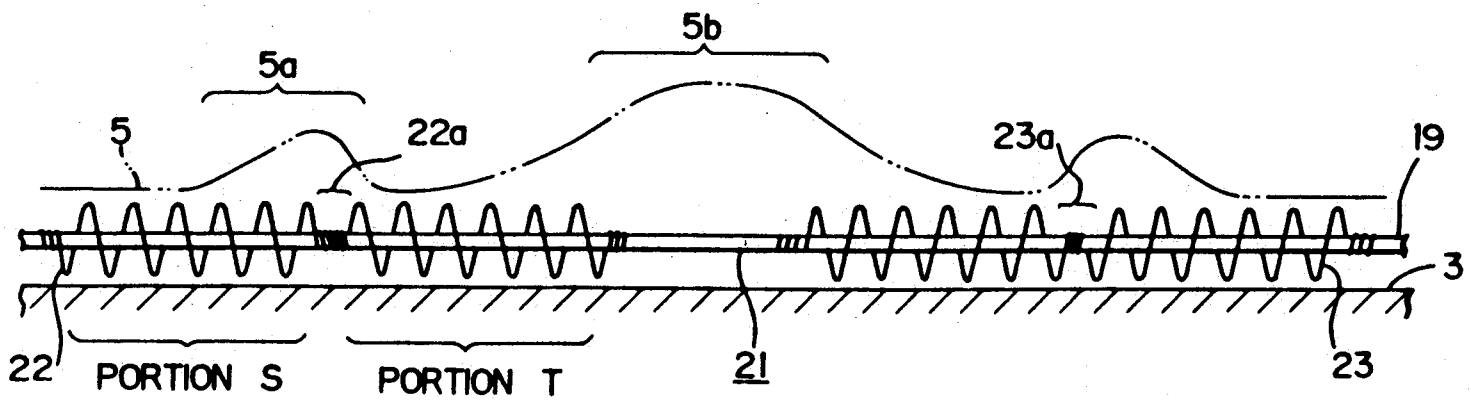
FIG. 4 is a view showing a circulating state of toner in the toner hopper stirring portion in FIG. 3.

In FIG. 4 the toner 5 is denoted by a two dot chain line and the first and second helical members 22 and 23 are disposed at a given interval from the frame 3. Assume that the end side of the first helical member 22 and the side opposite to the end side of the first helical member 22 at the central side of the toner hopper stirring portion 21 are respectively called an S portion and a T portion bordering on each other at the toner conveying speed varying portion 22a. When the amount of toner 5 in the toner hopper portion is so reduced that it does not sufficiently cover the toner hopper stirring portion 21, the toner 5 conveyed from the end side of the first helical member 22 by the S portion forms a heap portion 5a at the portion adjacent to the toner conveying speed varying portion 22a. The heap portion 5a is formed because the toner conveying speed varying portion 22a has a small conveying ability and the toner 5 conveyed from the end side of the toner hopper stirring portion 21 is successively supplied to the toner conveying speed varying portion 22a. When the toner 5 is further conveyed by the S portion, the toner 5 on the heap portion 5a starts to collapse toward the central side of the toner hopper stirring portion 21. The toner 5 thus collapsed from the heap portion 5a toward the central side of the toner hopper stirring portion 21 is conveyed by the T portion toward the central side of the toner hopper stirring portion 21 to thereby form a heap portion 5b.

The toner 5 conveyed by the second helical member 23 is conveyed in the same way as by the first helical member 22. At the state where the amount of toner 5 is too small to sufficiently cover the toner hopper stirring portion 21, a part of the toner 5 to be conveyed from the end side of the toner hopper stirring portion 21 toward the central side thereof is blocked by the toner conveying speed varying portion 23a and forms a heap portion at the blocked portion. Accordingly, the toner 5 is not concentrated at the central portion of the toner hopper portion 8 but distributed therein so that the height of the toner 5 is uniform.

According to the first embodiment, one toner conveying speed varying portion is provided for one helical member but a plurality of toner conveying speed varying portions may be provided for each helical member if the hopper stirring portion is long.

SECOND EMBODIMENT (FIG. 5)

Figure 5:
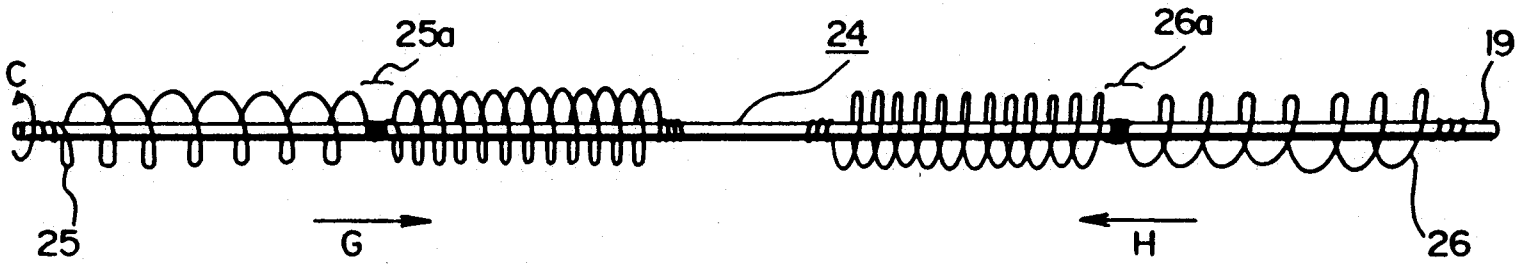
FIG. 5 is a perspective view showing the external appearance of a toner hopper stirring portion of a developing device according to a second embodiment of the present invention.

A developing device according to a second embodiment will be described with reference to FIG. 5 which shows the external appearance of a toner hopper stirring portion 24.

The developing device of the second embodiment is the same as that of the first embodiment except for the toner hopper stirring portion 24. Hence, an explanation of the elements with the exception of the toner hopper stirring portion 24 is omitted.

The toner hopper stirring portion 24 comprises a shaft 19 and first and second helical members 25 and 26 which are fixed to the shaft 19 by welding, etc. The first and second helical members 25 and 26 are formed of coils by machining a wire such as a piano wire.

The first helical member 25 has a toner conveying speed varying portion 25a at the central portion thereof. The toner conveying speed varying portion 25a is closely wound around the shaft 19 being in close contact with the shaft 19 at the inner diameter thereof. The first helical member 25 is formed of a coil having a uniform outer diameter but a winding pitch which is smaller at the central side than the winding pitch at the end side of the toner hopper stirring portion 24, while both sides border on each other at the toner conveying speed varying portion 25a. The toner conveying speed at the toner conveying speed varying portion 25a can be reduced remarkably compared with the toner conveying speed at other sides of the first helical member 25, and the toner conveying speed at the central side of the toner hopper stirring portion 24 is reduced compared with that at the end sides thereof.

The second helical member 26 is wound around the shaft 19 in the direction opposite to that of the first helical member 25 and is formed of a coil having an outer diameter which is the same as that at the first helical member and is provided with a toner conveying speed varying portion 26*a* at the central portion thereof. The winding pitch of the coil at the central side of the toner hopper stirring portion 24 is smaller than, the winding pitch of the coil at the end side thereof both sides bordering on each other at the toner conveying speed varying portion 25*a*.

The toner hopper stirring portion 24 stirs toner by the rotation of the shaft 19 in the direction of the arrow C while the first helical member 25 conveys toner in the direction of the arrow G and the second helical member 26 conveys toner in the direction of the arrow H.

The stirring operation of the toner hopper stirring portion 24 will be described with reference to FIG. 6 which shows the state where toner is circulated in the toner hopper stirring portion 24 according to the second embodiment.

Figure 6:
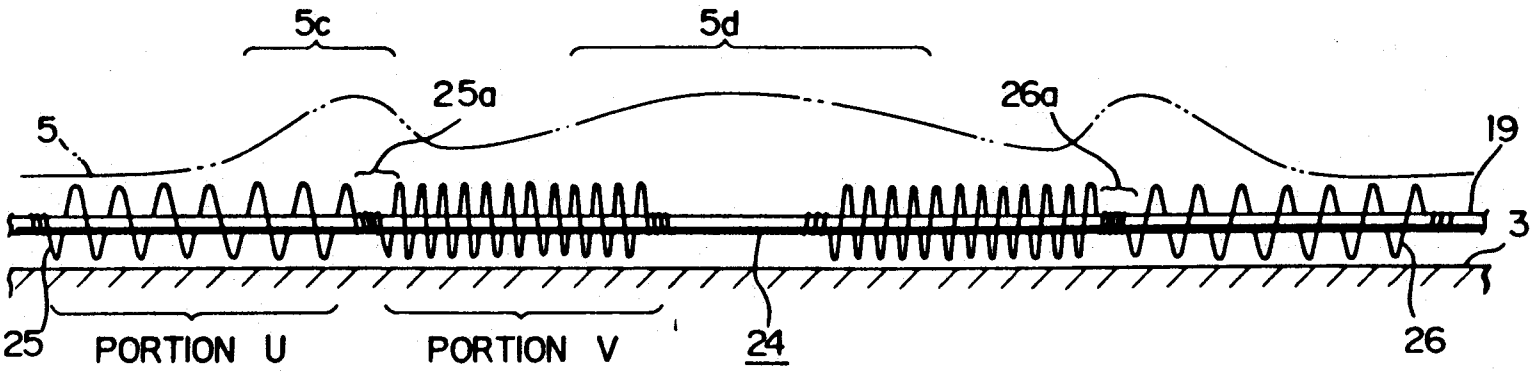
FIG. 6 is a view showing a circulating state of toner in the toner hopper stirring portion in FIG. 5.

In FIG. 6, denoted at a two dot chain line is toner 5 and the first and second helical members 25 and 26 are disposed in a given interval relative to the frame 3. Assume that the end side portion of the first helical member 25 is the U portion and a central side portion is a V portion while the U portion and the V portion are bordered on each other at the toner conveying speed varying portion 25*a*.

When the amount of toner 5 in the toner hopper portion is reduced to the extent that the toner hopper stirring portion 24 is not sufficiently covered, the toner 5 conveyed from the end to the U portion of the first helical member 25 forms a heap portion 5*c* at the portion adjacent to the toner conveying speed varying portion 25*a*. The heap portion 5*c* is formed because the toner conveying speed varying portion 25*a* has a small conveying ability and the toner 5 conveyed from the end side of the toner hopper stirring portion 24 is successively supplied to the toner conveying speed varying portion 25*a*. When the toner 5 is further conveyed by the U portion, toner 5 on the heap portion 5*c* starts to collapse toward the central portion of the toner hopper stirring portion 24. The toner 5 thus collapsed from the heap portion 5*c* toward the central portion of the toner hopper stirring portion 24 is conveyed by the V portion toward the central portion of the toner hopper stirring portion 24 to thereby form a heap portion 5*d*.

Toner 5 conveyed by the second helical member 26 is conveyed in the same way as the first helical member 25. At the state where the amount of toner 5 is too reduced to sufficiently cover the toner hopper stirring portion 24, the toner 5 to be conveyed from the end portion of the toner hopper stirring portion 24 toward the central portion thereof is blocked by the toner conveying speed varying portion 26*a* and forms a heap portion at the blocked portion.

According to the second embodiment, since the conveying speed at the V portion is set to be lower than that at the U portion, the amount of toner to be conveyed from the V portion to the central portion of the toner hopper stirring portion 24 is less than the amount of toner to be successively conveyed from the U portion to the toner conveying speed varying portion 25*a*. Accordingly, much toner heaps on the heap portion 5*c* compared with that of the first embodiment and the amount of toner heaped on the V portion is greater than that of the first embodiment.

Furthermore, since the amount of toner to be conveyed from the V portion to the central portion of the toner hopper stirring portion 24 is reduced, the amount of toner heaped at the heap portion 5*d* in the central portion is reduced so that the height of the heap portion 5*d* is low and the slope in the heap portion 5*d* is gentle.

According to the second embodiment, since the amount of toner which heaps on the toner conveying speed varying portion 25*a* is increased and the amount of toner which heaps at the central portion is reduced, the toner is distributed in the toner hopper portion so that the height of the toner 5 is uniform.

THIRD EMBODIMENT (FIG. 7)

Figure 7:
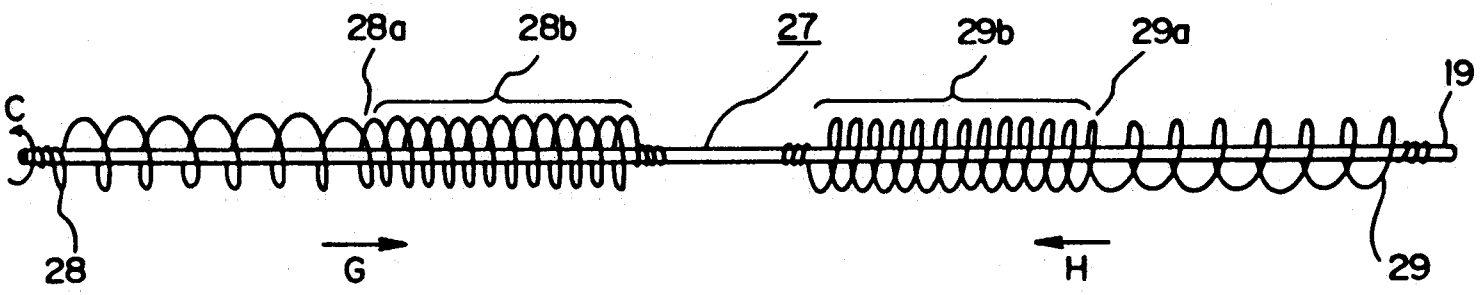
FIG. 7 is a perspective view showing the external appearance of a toner hopper stirring portion of a developing device according to a third embodiment of the present invention.

A developing device according to a third embodiment will be described with reference to FIG. 7 which shows the external appearance of a toner hopper stirring portion 27.

The developing device of the third embodiment is the same as that of the first embodiment except for the toner hopper stirring portion 27. Hence, an explanation of the elements with the exception of the toner hopper stirring portion 27 is omitted.

The toner hopper stirring portion 27 comprises a shaft 19 and first and second helical members 28 and 29 which are fixed to the shaft 19 by welding, etc. The first and second helical members 28 and 29 are formed of coil springs by machining a wire such as a piano wire.

The first helical member 28 is formed of a coil having a contact outer diameter along its length but winding pitches which are different for the two portions bordering on each other at the central portion 28*a* thereof. The winding pitch of the central side portion 28*b* is smaller than the winding pitch of an end side portion of the first helical member, i.e., at the end side of the shaft 19. As a result, the toner conveying speed at the side of the central side portion 28*b* is slower than that at the end side portion while both side portions are bordered on each other at the central portion 28*a*.

The second helical member 29 is formed of a coil having an outer diameter which is the same as but wound in the direction opposite to the first helical member 28. In the second helical member the winding pitch of the central side portion 29*b* is smaller than that of the end side portion, both side portions being bordered on each other at the middle portion 29*a*.

The toner hopper stirring portion 27 stirs toner by rotation of the shaft 19 in the direction of the arrow C so that the first helical member 28 conveys toner in the direction of the arrow G and the second helical member 29 conveys toner in the direction of the arrow H.

The stirring operation of the toner hopper stirring portion 27 will be described with reference to FIG. 8 which shows the state where toner is circulated in the toner hopper stirring portion 27 according to the third embodiment.

Figure 8:
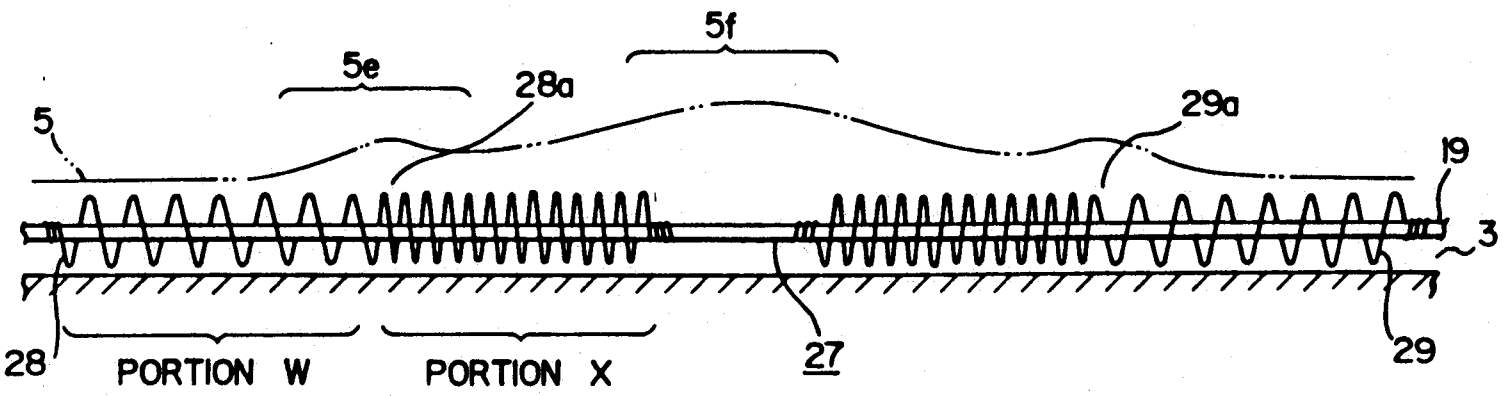
FIG. 8 is a view showing a circulating state of toner in the toner hopper stirring portion in FIG. 7.

In FIG. 8, denoted at a two dot chain line is toner 5 and the first and second helical members 28 and 29 are disposed at a given interval relative to the frame 3. Assume that an end portion of the first helical member 28 is a W portion and a central side portion thereof is an X portion while the W portion and the X portion are bordered on each other at the central portion 28*a*.

When the amount of toner in the toner hopper portion is too reduced to sufficiently cover the toner hopper stirring portion 27, the toner 5 conveyed from the end side of the toner hopper stirring portion 27 forms a heap portion 5e at the portion adjacent to the middle portion 28a because the conveying speed in the W portion is set to be smaller than that in the X portion, so that the amount of toner successively fed to the W portion exceeds that conveyed to the central portion of the toner hopper stirring portion 27 by the X portion.

The toner 5 conveyed to the central portion by the X portion forms a heap portion 5f.

The second helical member 29 conveys toner in the same way as the first helical member 28.

When the amount of toner in the toner hopper portion is too reduced to sufficiently cover the toner hopper stirring portion 27, the toner 5 conveyed from the end side to the central portion of the toner hopper stirring portion 27 forms a heap portion 5e at the portion adjacent to the middle portion 28a because of the difference in conveying speeds between the W portion and the X portion.

According to the third embodiment, the toner conveying speed is slowed from the middle portion 28a, but the third embodiment does not have the toner conveying speed varying portions which are formed in the second embodiment. Accordingly, the amount of toner which heaps on the heap portion 5e is less than that in the second embodiment in which the toner conveying power is not applied to the toner at the toner conveying speed varying portion. Since the amount of toner which heaps on the X portion is large but the amount of toner which heaps on the heap portion 5f is small in the same way as the second embodiment, the toner 5 in the toner hopper portion is distributed more uniformly.

Figure 9:
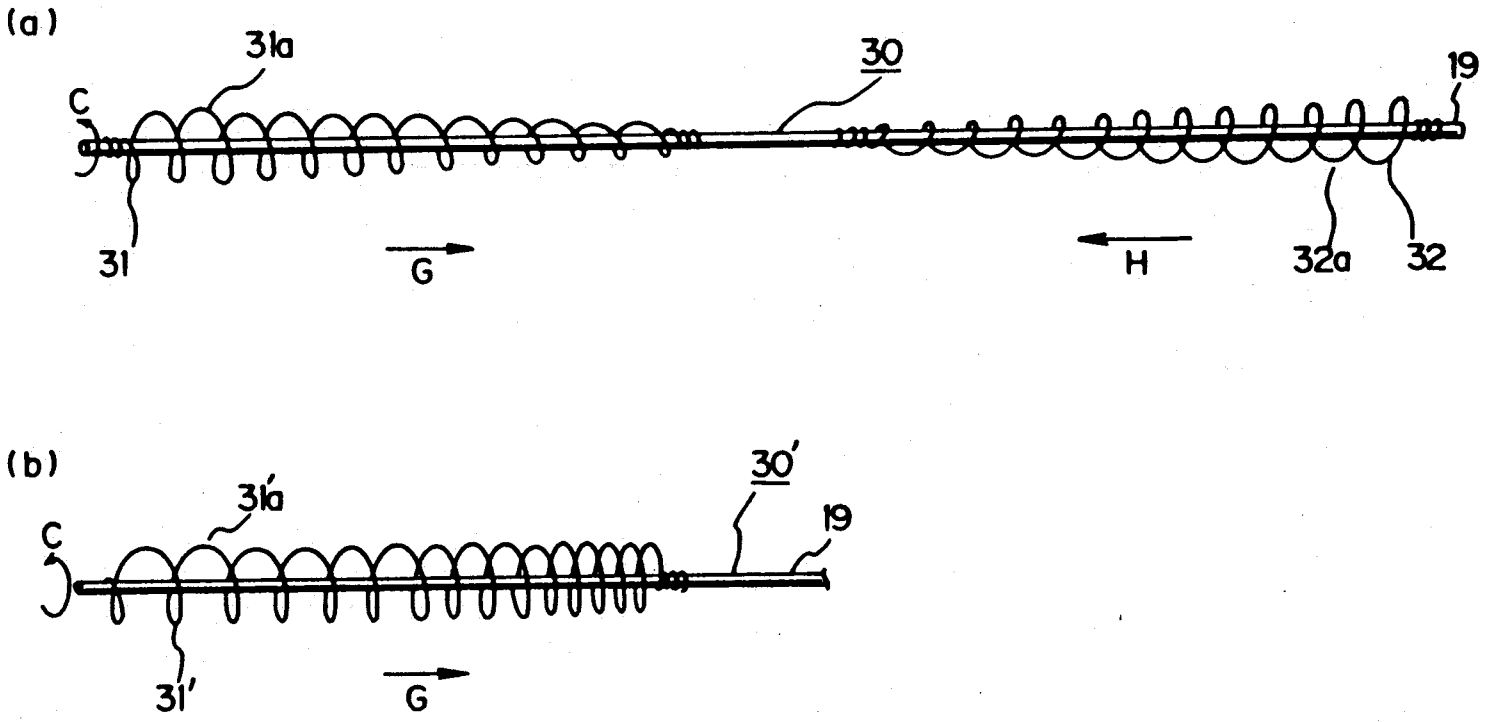
FIG. 9 is a perspective view showing the external appearance of a toner hopper stirring portion of a developing device according to a fourth embodiment of the present invention.

FOURTH EMBODIMENT (FIGS. 9(*a*) and 9(*b*))

A developing device according to a fourth embodiment will be described with reference to FIG. 9(*a*) which shows the external appearance of a toner hopper stirring portion 30 thereof.

The developing device of the fourth embodiment is the same as that of the first embodiment except for the toner hopper stirring portion 30. Hence an explanation of the elements with the exception of the toner hopper stirring portion 30 is omitted.

The toner hopper stirring portion 30 comprises a shaft 19 and first and second helical members 31 and 32 which are fixed to the shaft 19 by welding, etc. The first and second helical members 31 and 32 are formed of coils respectively by machining a wire such as a piano wire.

The first helical member 31 is formed of a coil which has a constant winding pitch. The outer diameter of the coil between one end side of the shaft 19 to a changing point 31a is gradually decreased from the changing point 31a to the other side thereof in the direction of the central portion of the shaft 19.

The second helical member 32 is formed of a coil which is wound in the direction opposite to that of the first helical member 31 and has a constant winding pitch. The outer diameter of the coil between one end side thereof to a changing point 32a is gradually decreased from the changing point 32a to the other side thereof in the direction of the central portion of the shaft 19.

The toner hopper stirring portion 30 stirs toner by rotation of the shaft 19 in the direction of the arrow C so that the first helical member 31 conveys toner in the direction of the arrow G and the second helical member 32 conveys toner in the direction of the arrow H while stirring the same.

The stirring operation of the toner hopper stirring portion 30 will be described with reference to FIG. 10 which shows the state where toner is circulated in the toner hopper stirring portion 30 according to the fourth embodiment.

Figure 10:
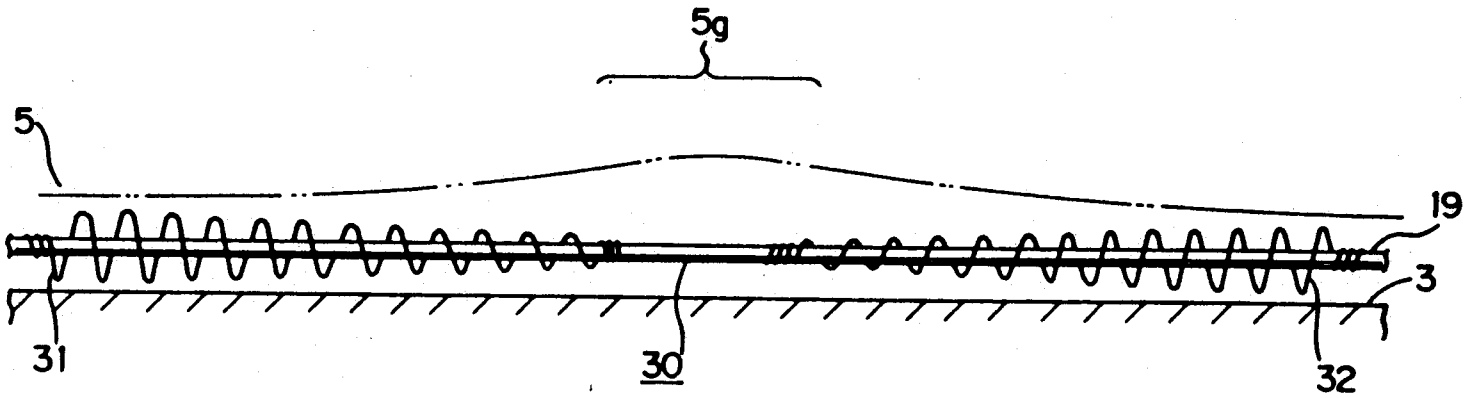
FIG. 10 is a view showing a circulating state of toner in the toner hopper stirring portion in FIG. 9.

In FIG. 10, denoted at a too dot chain line is toner 5 and the first and second helical members 31 and 32 are disposed at a given interval relative to the frame 3.

As set forth above, the first helical member 31 is structured such that the toner conveying speed is gradually slowed from the end side portion to the central side portion thereof. Accordingly, the amount of toner to be conveyed by the first helical member 31 is gradually increased from the central portion to the end side. If the amount of toner is too reduced to sufficiently cover the toner hopper stirring portion 30, a heap portion 5g is formed at the central portion of the toner hopper stirring portion 30.

The toner to be conveyed by the second helical member 32 is conveyed in the same manner as the first helical member 31.

According to the fourth embodiment, the toner conveying speed is gradually slowed from the end side portion to the central side portion of each of the first and second helical members 31 and 32. Thus the toner is prevented from heaping locally which entails more uniform supply of the toner.

The toner conveying speed is changed by varying the diameter of the coil as set forth above but can be changed by the winding pitch of the coil as illustrated in FIG. 9(*b*). That is, the winding pitch of the coil of a helical member 31' of a toner hopper stirring portion 30' is varied such that it is gradually reduced from a changing point 31'a in the toner conveying direction to thereby vary the toner conveying speed so as to uniformly supply the toner.

FIFTH EMBODIMENT (FIG. 11)

A developing device according to a fifth embodiment will be described with reference to FIG. 11 which is a cross-sectional view of the developing device 40. The developing device 40 has a toner cartridge 41 which contains toner therein and extends in the width direction of a printing paper to be fed, and is mounted on the mounting portion 3a of the frame 3 of the developing device 40.

Figure 11:
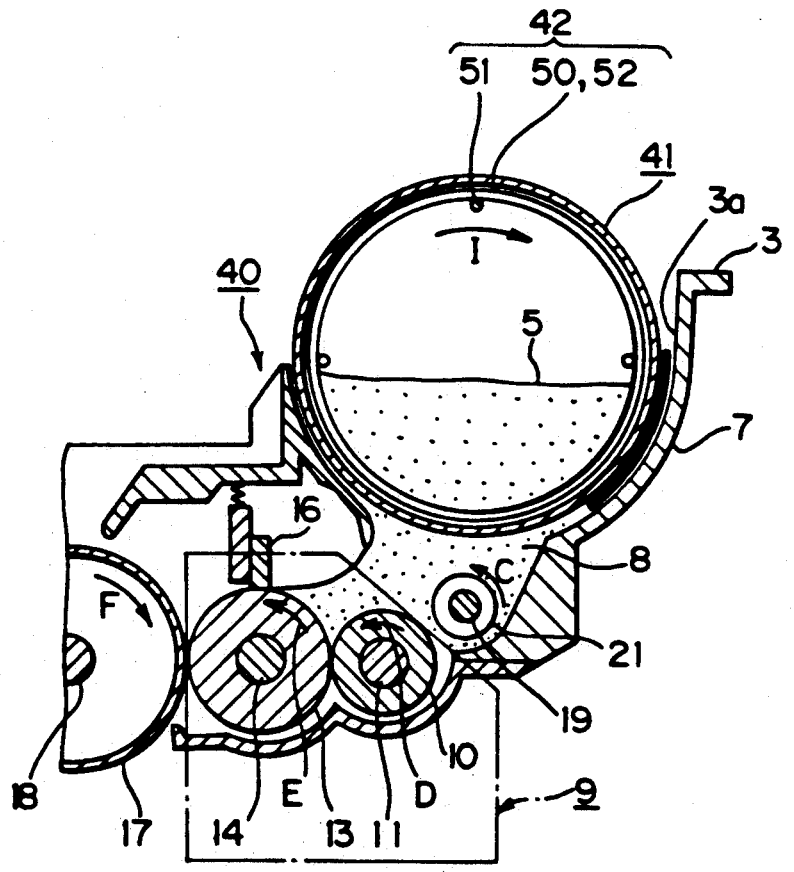
FIG. 11 is a cross-sectional view of a developing device according to a fifth embodiment of the present invention.

As illustrated in FIG. 11, the toner cartridge 41 mounted on the developing device 40 has a cartridge stirring portion 42 which conveys the toner 5 in the cartridge 41 while stirring the same. The cartridge stirring portion 42 conveys the toner 5 in the direction opposite to the direction in which the toner stirring portion 21 in the toner hopper portion 8 conveys the toner 5. The cartridge stirring portion 42 is connected to a driving means for driving a supply roller 10, etc. when the toner cartridge 41 is mounted on the developing device 40.

Figure 12:
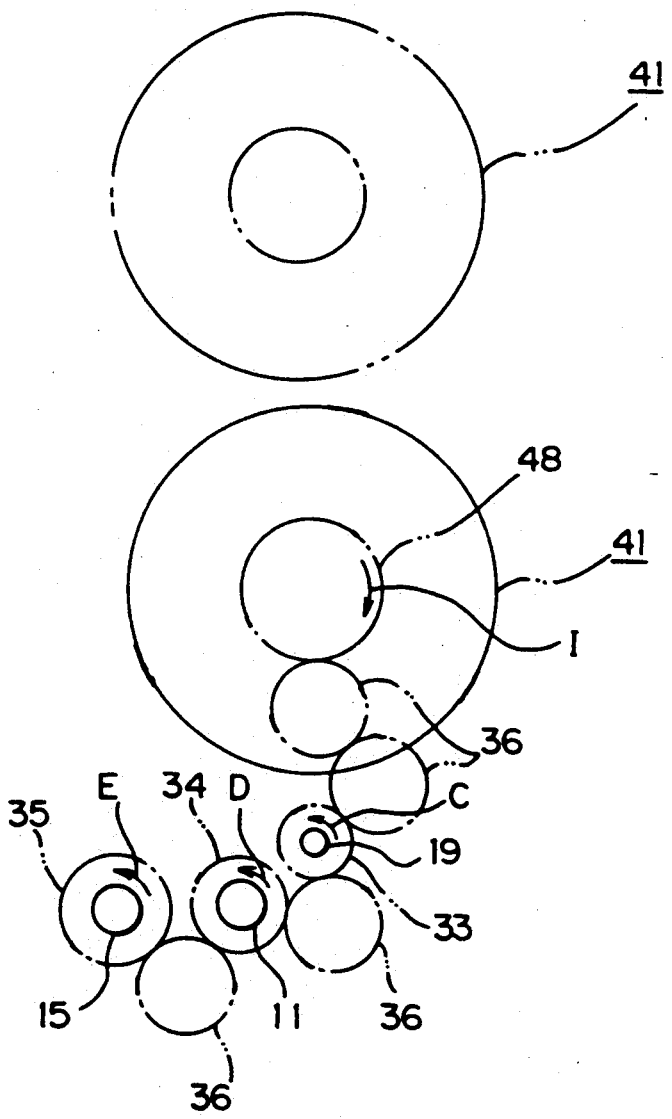
FIG. 12 is a view showing the connecting state of rollers which are driven when a toner cartridge is mounted on the developing device in FIG. 11.

FIG. 12 shows the connecting state of the driving means when the toner cartridge 41 is mounted on the developing device.

As illustrated in FIG. 12, shafts 19, 11 and 15 are driven by driving gears 33, 34 and 35 and the cartridge stirring portion 42 is driven by a driving gear 48. The driving gears 33 and 34, 34 and 35, and 35 and 48 are connected with one another via idle gears 36. Each gear is roughly illustrated by a (one dot chain line) pitch circle.

Solid lines in FIG. 12 shows the state where the toner cartridge 41 is mounted on the developing device and two dot chain lines in FIG. 12 show the state where the toner cartridge 41 is dismounted from the developing device. When the toner cartridge 41 is mounted on the developing device, the driving gear 48 is connected to the idle gears 36 to thereby transmit the driving force to the cartridge stirring portion 42.

Other arrangements of the developing device are the same as those in the first embodiment, hence the explanation thereof is omitted.

SIXTH EMBODIMENT (FIGS. 13 TO 15)

Figure 13:
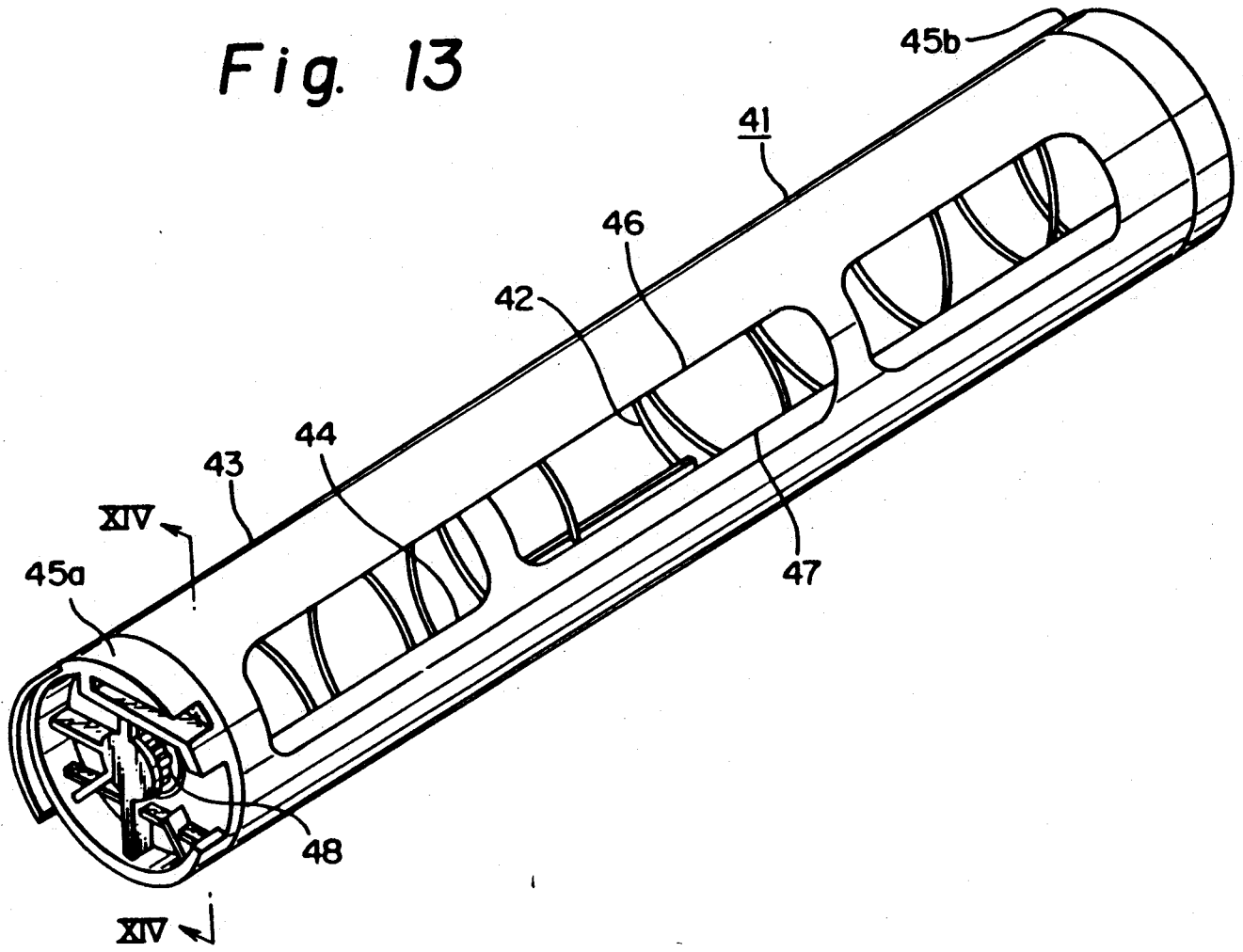
FIG. 13 is a perspective view showing the external appearance of the toner cartridge which is employed in the sixth embodiment in FIG. 11.

FIG. 13 shows the external appearance of a toner cartridge as employed in a developing device according to a sixth embodiment.

In FIG. 13, the toner cartridge comprises an outer cylinder 43 and an inner cylinder 44. The outer and inner cylinders 43 and 44 are substantially the same in length and the inner cylinder 44 is brought into contact with the inner periphery of the outer cylinder 43 at the entire length thereof. End plates 45*a* and 45*b* are fixed to both ends of the inner cylinder so as to close the inner cylinder 44. The outer diameters of the end plates 45*a* and 45*b* are substantially the same as the outer diameter of the outer cylinder 43.

With such an arrangement, the outer cylinder 43 does not get out of position and can turn relative to the inner cylinder 44.

Both the outer and inner cylinders 43 and 44 have openings 46 and 47 at their side surfaces. When both the outer and inner cylinders 43 and 44 are turned relative to each other, the toner cartridge 41 can be opened, whereby the toner into the toner cartridge 41 can drop in the toner hopper portion 8 through the openings 46 and 47. The toner cartridge 41 has inside thereof a cartridge stirring portion 42 which is supported integrally with a gear 48 by the toner cartridge 41.

Figure 14:
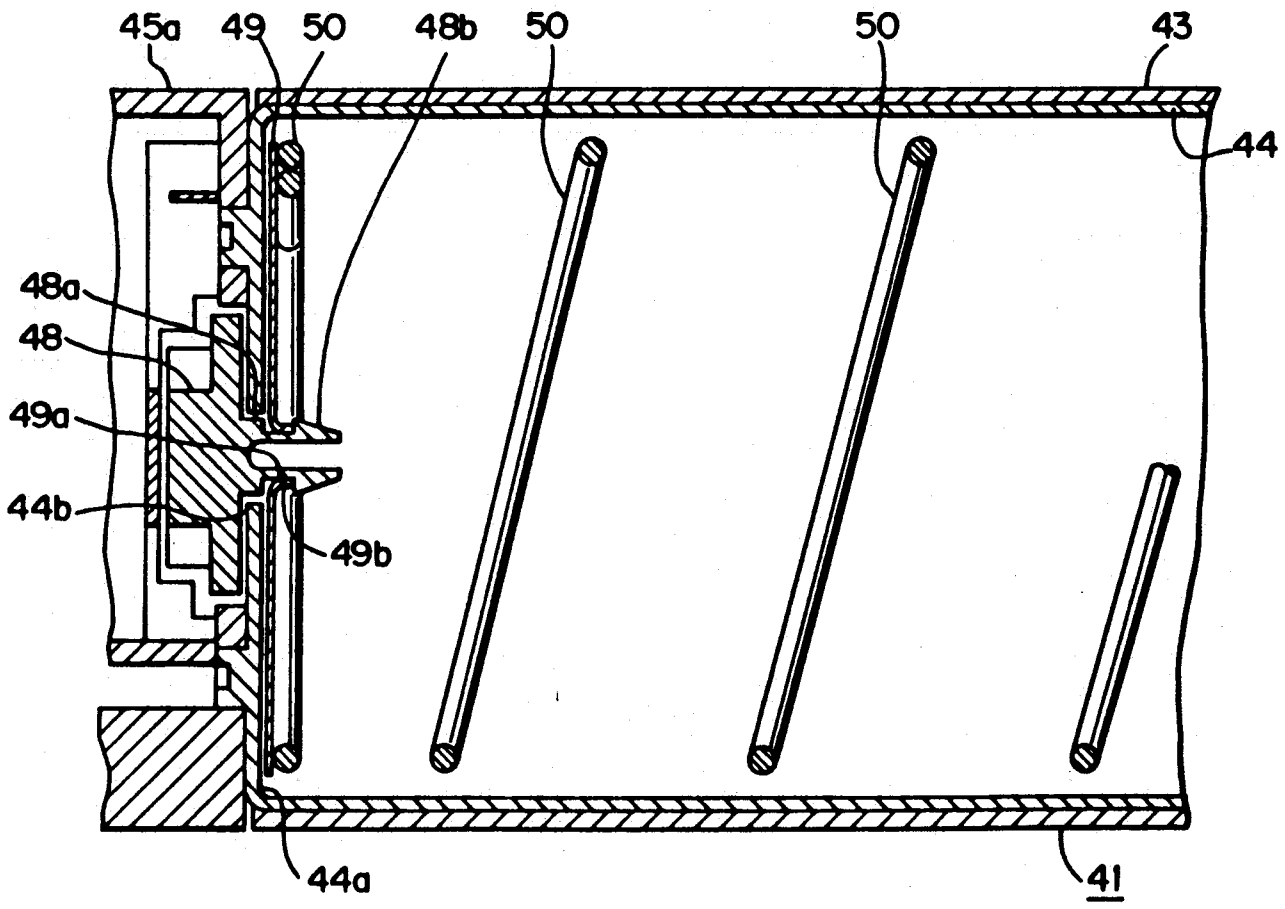
FIG. 14 is a cross-sectional view taken along line XIV—XIV in FIG. 13.

In FIG. 14 which is a cross-sectional view taken along arrows XIV—XIV in FIG. 13, the gear 48 has a shaft portion 48*a* and a pawl 48*b* which are integrally formed with the gear 48. The shaft portion 48*a* has a central axis, not shown, which is common to the gear 48 and a first helical portion 50. The central axis penetrates a round hole 44*b* provided at the center of the end surface 44*a* of the inner cylinder 44 and is turnably supported by the inner cylinder 44. The pawl 48*b* penetrates an angular hole 49*a* provided in an end surface member 49 and engages with a projecting portion 49*b*. A root of the pawl 48*b* which penetrates the angular hole 49*a* has a cross-sectional shape which is brought into contact with an inner surface of the angular hole 49*a*, whereby the end surface member 49 is turned while driven by the rotation of the gear 48.

The end surface member 49 is a rectangular metallic plate to which the first helical portion 50, which is formed by machining a wire such as a piano wire, etc., is fixed by silver brazing, soldering or (projection) welding.

The gear 48 is connected to a driving means for driving the supply roller 10 (refer to FIG. 11), etc., when the toner cartridge 41 is mounted on the developing device 40.

Figure 15:
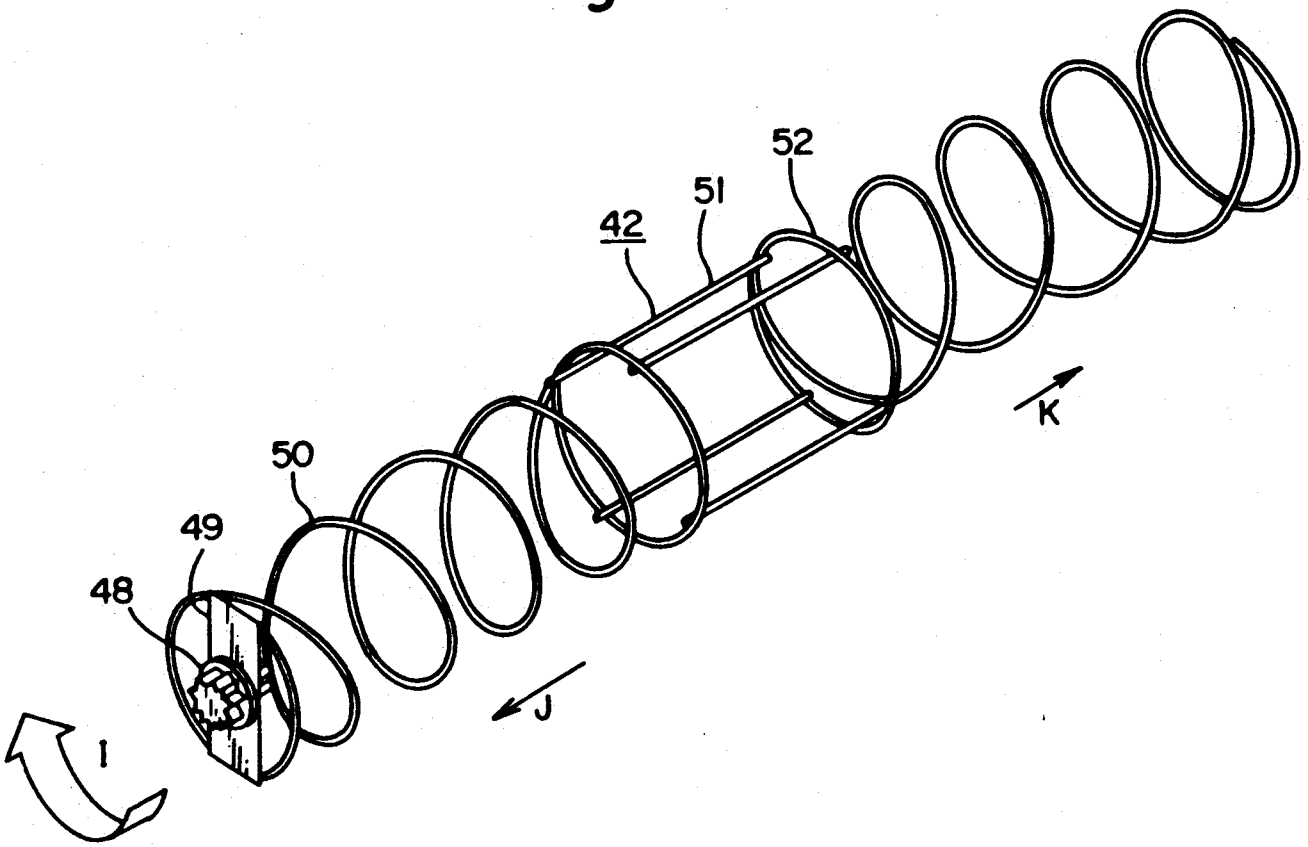
FIG. 15 is a perspective view showing a cartridge stirring portion in FIG. 11.

FIG. 15 is a perspective view of the external appearance of the cartridge stirring portion 42.

As illustrated in FIG. 15, the cartridge stirring portion 42 comprises the gear 48, the end surface portion 49, the first helical member 50, a central portion 51 and a second helical portion 52.

The first and second helical portions are formed of coils by machining a wire such as a piano wire,etc. The first helical portion 50, the central portion 51 and the second helical portion 52 are fixed to one another by silver brazing, soldering or (projection) welding, etc.

The first helical portion 50 and the second helical portion 52 are wound in the directions opposite to each other. Accordingly, when the gear 48 is driven to turn the cartridge stirring portion 42 in the direction of an arrow I, toner, not shown, is stirred and conveyed in the toner cartridge 41 from the central portion 51 to the end side portions of the first and second helical portions 50 and 52 in the directions of arrows J and K.

The operation of the developing device is described with reference to FIGS. 11 and 13.

The toner cartridge 41 mounted on the developing device 40 opens the openings 46 and 47 to thereby drop the toner 5 to the toner hopper portion which is disposed under the toner cartridge 41.

The toner 5 dropped and heaped on the toner hopper portion 8 is stirred in the toner hopper portion 8 by the rotation of the toner hopper stirring portion 21 in the direction of the arrow C and is conveyed toward the central portion of the toner hopper portion 8 while stirred and a part of the toner 5 is supplied to the supply roller 10 of the developing portion 9.

The toner supplied from the toner hopper portion 8 to the supply roller 10 is supplied to the electrostatic latent image on the surface of the photoconductor drum 17 and develops the electrostatic latent image in the conventional manner.

When the amount of toner in the toner cartridge 41 begins to reduce, the toner 5 tends to be distributed locally at both ends of the toner cartridge 41 since it is conveyed by the turning of the toner cartridge stirring portion 42 in the direction of the arrow I. Accordingly, the toner 5 is supplied concentrically to both ends of the toner hopper portion 8.

In the toner hopper portion 8, although the toner 5 on both ends of the toner hopper portion 8 is conveyed toward the central portion thereof by the stirring operation of the toner hopper stirring portion 21, the toner is prevented from being distributing locally in the central portion thereof since the toner 5 supplied from the toner cartridge 41 is concentrically supplied to both ends thereof.

In the fifth embodiment, in the toner hopper portion 8, the toner is stirred and conveyed from both ends thereof toward the central portion thereof while the toner is concentrically supplied to both ends thereof from the toner cartridge 41, whereby the toner is prevented from heaping locally and is supplied uniformly to the developing roller. Although the toner is stirred and conveyed toward both ends of the toner cartridge 41, the toner conveying direction in the toner cartridge 41 is not limited to both ends thereof but it may be opposite to the toner conveying direction by the toner hopper stirring portion in the toner hopper portion.

It is possible to prevent the reduction of toner at both ends of the toner hopper portion to thereby facilitate the uniform supply of the toner if the arrangement of fifth embodiment is combined with the toner hopper stirring portions as set forth in the first to fourth embodiments.

Figure 16:
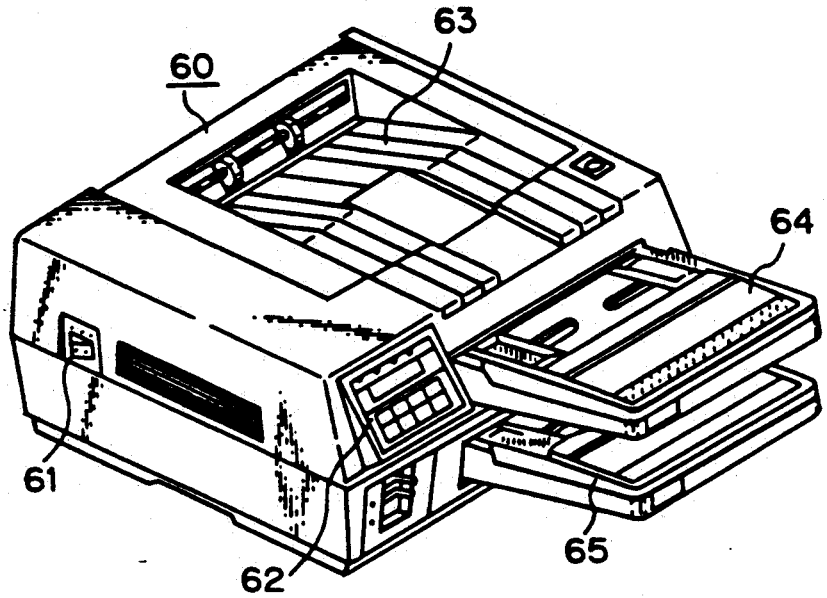
FIG. 16 is a perspective view showing the external appearance of an electrophotographic recording apparatus employing the developing device according to the first to fifth embodiments of the present invention.

FIG. 16 is a perspective view of the external appearance of the electrophotographic recording apparatus employing the developing device of the present invention.

In FIG. 16, the electrophotographic recording apparatus 60 includes a power source switch 61 for actuating the electrophotographic recording apparatus 60, an operation panel for indicating setting of a printing condition and an error state of the electrophotographic recording apparatus 60 and a stacker on which the printed paper is let out. The electrophotographic recording apparatus 60 has printing paper cassettes 64 and 65 at one side thereof. The printing paper casettes 64 and 65 are detachable from the electrophotographic recording apparatus 60 and stack the printing papers thereon.

Figure 17:
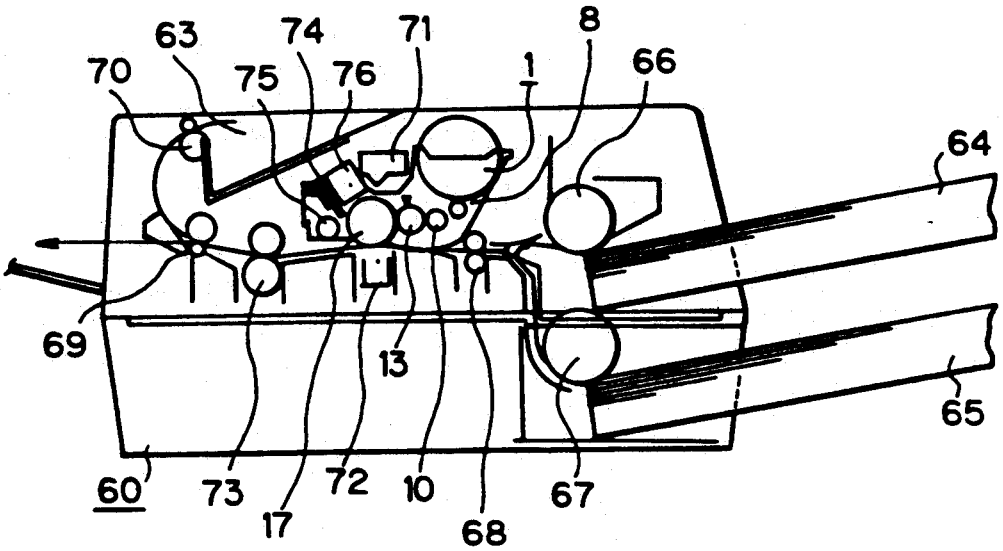
FIG. 17 is the view showing a printing process in the electrophotographic recording apparatus.

FIG. 17 is the view explaining a printing process of the electrophotographic recording apparatus 60.

In FIG. 17, the electrophotographic recording apparatus 60 includes therein feed rollers 66 and 67 for feeding the printing papers which are stacked on the printing paper cassettes 64 and 65, pairs of rollers 68, 69 and 70 for conveying the printing papers fed from the printing paper casettes 64 and 65 in the electrophotographic recording apparatus 60, an electrostatic charger 76 for uniformly applying electrostatic charge to the surface of the photoconductor drum 17, an LED array 71 for emitting light on the photoconductor drum 17 to thereby form an electrostatic latent image on the surface of the photoconductor drum 17, a transfer electrifier 72 for transferring the toner attached to the photoconductor drum to the printing paper and a pair of heat rollers 73 for fixing the toner, transferred onto the printing paper, to the printing paper by heat and pressure.

The printing process will be described with reference to FIG. 17.

The printing paper fed from the printing cassette 64 or 65 through the feed roller 66 or 67 is conveyed to the photoconductor drum 17 through the pair of rollers 68.

The feed of a printing paper 81 to the developing device 1 provided with the photoconductor drum 17 will be described with reference to FIG. 18.

Figure 18:
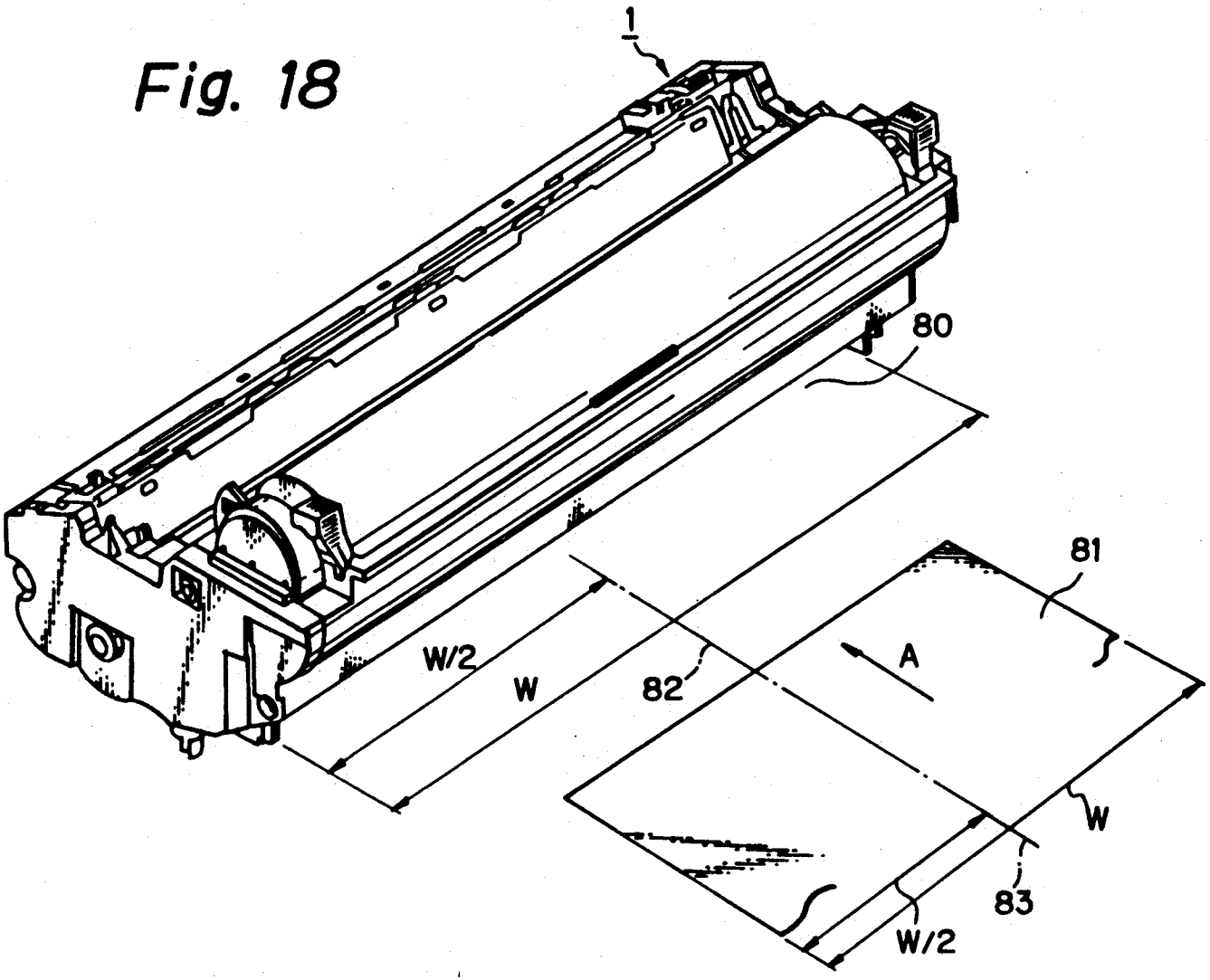
FIG. 18 is a view showing the state where a printing paper is fed to the developing device.

In FIG. 18, the center line 82 represents a center of a printing paper conveying path 80 in the width direction W thereof and a center line 83 represents the center of the printing paper 81 in the width direction W thereof. The printing paper 81 is fed toward the developing device in the direction of arrow A. At this time, the printing paper is fed by aligning its center line 83 with the center line 82 of the printing paper conveying path.

Referring back to FIG. 17, the photoconductor drum 17 is turned by a driving source, not shown, and is uniformly charged with electricity by the electrifier 76 and the electrostatic latent image is formed on its surface by the LED array 71 while the printing paper 81 is conveyed to the photoconductor drum 17. The electrostatic latent image charged with electricity on the surface of the photoconductor drum 17 is visualized by the toner supply roller 13 for supplying the toner 5. The visualized toner image is transferred onto the printing paper 81 by the transfer electrifier 72.

The toner which has not been transferred onto the printing paper 81 but remains on the surface of the photoconductor drum 17 is scraped by a cleaning blade 74 which contacts closely the surface of the photoconductor drum 17, whereby the photoconductor drum 17 is cleaned and the next image forming process starts. The toner thus scraped by the cleaning blade 74 is collected and conveyed to the toner hopper portion 8 and is recycled.

Figure 19:
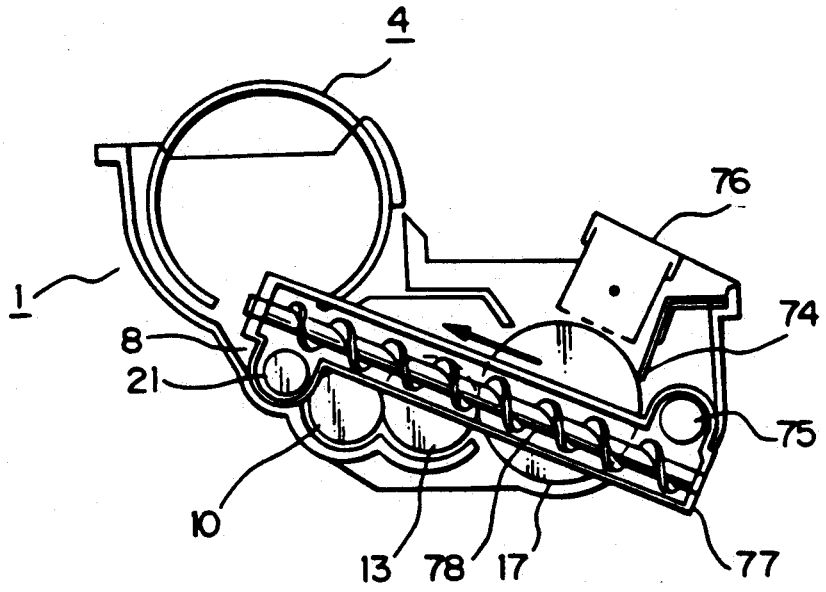
FIG. 19 is the view showing a conveying state of collected toner.
Figure 20:
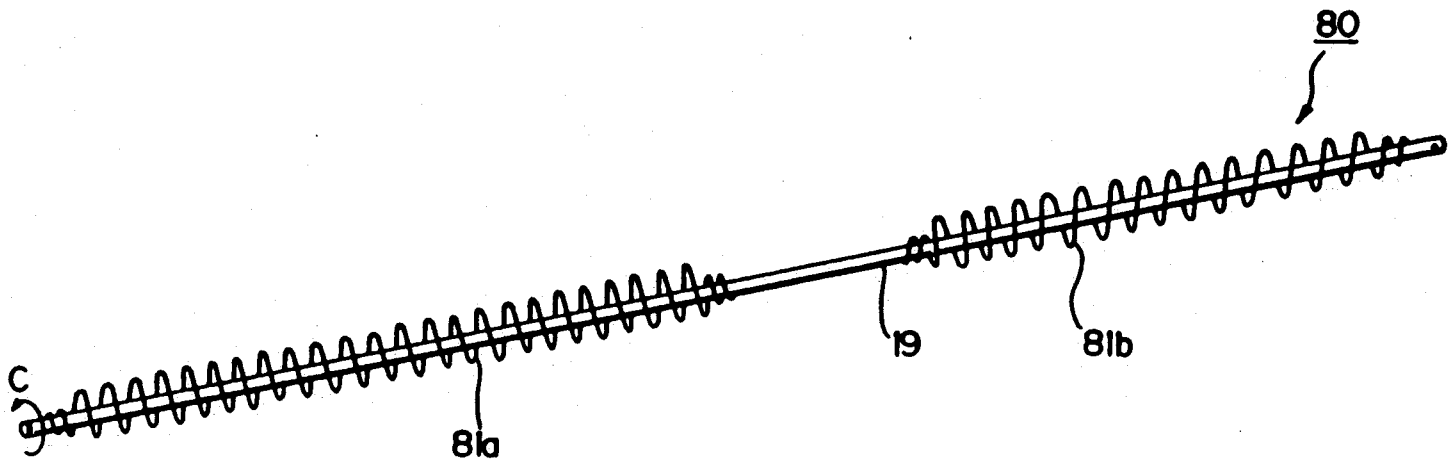
Fig. 20 PRIOR ART
FIG. 20 is a perspective view showing the external appearance of the toner hopper portion of a conventional developing device.

The recycle of the collected toner will be described with reference to FIG. 19 showing the conveying of the collected toner.

In FIG. 19 showing the developing device from the side thereof, the toner collected from the photoconductor drum 17 by the cleaning blade 74 is conveyed to a recycling route 77, which is provided at the side of the developing device, by a collected toner conveying spiral 75. The toner conveyed to the recycling route 77 is conveyed by a recycling spiral 78 to a portion adjacent to the end of the toner hopper stirring portion 21 in the toner hopper portion 8. Both the collected toner conveying spiral 75 and the recycling spiral 78 are means for conveying the toner 5 and are formed of spiral members (the recycling spiral 78 alone is illustrated as a spiral member in FIG. 19) which are turned to thereby convey the toner.

Referring back to FIG. 17, the toner image is transferred by the transfer electrifier 72 on the printing paper 81 and the thus transferred toner image is fixed on the printing paper by the heat roller 73. The printing paper having the toner image fixed thereto is discharged toward the stacker portion 63 and the printing process ends.

Although the invention has been described in its preferred form with a certain degree of particularity, it is to be understood that many variations and changes are possible in the invention without departing from the scope thereof.

What is claimed is:

1. A developing device comprising a developing portion for supplying toner to an electrostatic latent image on a photoconductor drum and developing said latent image, a toner hopper portion for collecting toner therein and supplying the toner to the developing portion, a stirring portion disposed in the toner hopper portion and composed of a shaft; and first and second helical members which are wound around the shaft in the directions opposite to each other wherein the first and second helical members are turned to thereby stir a part of the toner and convey the same toward the central portion of the toner hopper portion; the first and second helical members being formed of coil shaped members, respectively; and the first and second helical members being provided with first and second toner conveying speed varying portions for changing the conveying speed of toner, respectively.

2. A developing device according to claim 1, wherein the first and second toner conveying speed varying portions are formed by reducing winding diameters at given positions of the first and second helical members, respectively.

3. A developing device according to claim 1, wherein the first and second toner conveying speed varying portions comprise first toner conveying speed varying portions formed by reducing the winding diameters at given portions of the first and second helical members and second toner conveying speed varying portions formed by reducing winding pitches at given portions of the first and second helical members; the first toner conveying speed varying portions being provided at given portions on the first and second helical portions at the given positions and given intervals; the second toner conveying speed varying portions being provided between the given positions of the first and second helical portions and the ends of the toner conveying direction sides.

4. A developing device according to claim 1, wherein the toner conveying speed varying portions are formed by reducing winding pitches of the first and second helical members and wherein the toner conveying speed varying portions are provided on the first and second helical portions between given positions of the first and second helical portions and the ends of the toner conveying direction sides.

5. A developing device according to claim 1, wherein the toner conveying speed varying portions are formed by gradually reducing winding diameters of the first and second helical members in the toner conveying directions and wherein the toner conveying speed varying portions are provided on the first and second helical portions between given positions of the first and second helical portions and the ends of the toner conveying direction sides.

6. A developing device comprising a developing portion for supplying toner to an electrostatic latent image on a photoconductor drum and developing said latent image, said developing portion including a developing roller having an axis extending in a direction parallel to an axis of said photoconductor drum;

a toner cartridge, said toner cartridge including a toner cartridge stirring portion comprising third and fourth helical members wound in opposite directions;

a toner cartridge mounting portion for mounting said toner cartridge;

a toner hopper portion for collecting toner supplied from said toner cartridge and supplying the toner to said developing portion, said toner hopper portion including a toner hopper stirring portion comprising first and second helical members wound in opposite directions; and a driving means for stirring and conveying toner in a direction parallel to the axis of said developing roller toward a central portion or toward end side portions of the toner hopper portion by turning the first and second helical members of the toner hopper stirring portion, and for stirring and conveying toner in the toner cartridge in a direction parallel to the axis of said developing roller and opposite to the conveying direction of the toner in the toner hopper stirring portion by turning the third and fourth helical members of the toner cartridge stirring portion.

7. A developing device comprising a photoconductor drum for forming an electrostatic latent image on the peripheral surface thereof by charging with electricity by a charging means and by exposing the same by a light emitting means; a developing portion for supplying toner to the latent image on the outer periphery of the photoconductor drum and developing the latent image; a toner hopper portion for collecting toner therein and for supplying the toner to the developing portion; a toner stirring means composed of a shaft and first and second helical members which are wound around the shaft in the directions opposite to each other; a cleaning means for removing the toner which has not been transferred in a transfer process but remains on the outer periphery of the photoconductor drum; a toner conveying means for conveying the removed toner to the portion close to the end portion of the toner stirring portion wherein the first and second helical members are turned to thereby stir the toner and convey the toner toward the central portion of the toner hopper portion; the first and second helical members being formed of coiled members, said coiled members having the same outer diameters and winding pitches; the first and second helical members being respectively provided with toner conveying speed varying portions for changing the conveying speed of the toner.

8. A developing device according to claim 7, wherein the toner conveying speed varying portions are formed by reducing winding diameters of the first and second helical members and wherein the toner conveying speed varying portions are provided at given positions of the first and second helical portions.

9. A developing device according to claim 8, wherein the toner conveying speed varying portions are formed so as to contact the coils to the shaft and wherein the given positions of the coils on the first and second helical members are adjacent to the middle portions of the first and second helical members.

10. A developing device according to claim 7, wherein the toner conveying speed varying portions comprise first toner conveying speed varying portions formed by reducing the winding diameters of given portions of the first and second helical members and second toner conveying speed varying portions formed by reducing winding pitches of the first and second helical members; the first toner conveying speed varying portions being provided on the first and second helical portions at the given positions and given intervals; and wherein the second toner conveying speed varying portions are provided on the first and second helical portions between the given positions of the first and second helical portions and the ends of the toner conveying direction sides.

11. A developing device according to claim 10, wherein the toner conveying speed varying portions are formed so as to contact the coils to the shaft, the first toner conveying speed varying portions being provided at positions adjacent to the middle portions of the first and second helical members; and wherein the second toner conveying speed varying portions are provided between the ends of the toner conveying direction sides of the first and second helical members and the first toner conveying speed varying portions.

12. A developing device according to claim 7, wherein the toner conveying speed varying portions are formed by reducing winding diameters of the first and second helical members, and wherein the toner conveying speed varying portions are provided on the first and second helical portions between given positions of the first and second helical portions and the ends of the toner conveying direction sides.

13. A developing device according to claim 12, wherein the given positions on the first and second helical members are adjacent to the middle portions of the first and second helical members.

14. A developing device according to claim 7, wherein the toner conveying speed varying portions are formed by gradually reducing winding diameters of the first and second helical members toward the toner conveying directions, and wherein the toner conveying speed varying portions are provided on the first and second helical portions between given positions of the first and second helical portions and the ends of the toner conveying direction sides.

15. A developing device according to claim 14, wherein the given positions on the first and second helical members are adjacent to end portions of the first and second helical members.

16. A developing device according to claim 7, wherein the toner conveying speed varying portions are formed by gradually reducing winding pitches of the first and second helical members toward the toner conveying directions, and wherein the toner conveying speed varying portions are provided on the first and second helical portions between given positions of the first and second helical portions and the ends of the toner conveying direction sides.

17. A developing device according to claim 16, wherein the given positions on the first and second helical members are adjacent to the end portions of the first and second helical members.

18. A developing device comprising a photoconductor drum for forming an electrostatic latent image on the peripheral surface thereof by charging said drum with electricity by a charging means and by exposing said drum to a light emitting means;

a developing portion for supplying toner to the latent image on the outer periphery of the photoconductor drum and developing the latent image, said developing portion including a developing roller having an axis extending in a direction parallel to an axis of said photoconductor drum;

a toner hopper portion for collecting the toner therein and for supplying the toner to the developing portion;

a toner stirring means composed of a shaft; and first and second helical members wound around the shaft in opposite directions, the first and second helical members being formed of coiled members having the same outer diameters and winding pitches;

a toner cartridge portion, having opposite ends, for storing the toner therein and for supplying the toner to the toner hopper portion, said toner cartridge including a toner cartridge stirring portion comprising third and fourth helical portions wound in opposite directions, the third and fourth helical members having the same diameters and winding pitches;

a toner cartridge mounting portion for mounting the toner cartridge;

a cleaning means for removing toner which remains on the outer periphery of the photoconductor drum;

a toner conveying means for conveying the removed toner to a portion close to an end portion of the toner stirring portion wherein the first and second helical members are turned to thereby stir the toner and convey the toner in a direction parallel to the axis of said developing roller and toward a central portion of the toner hopper portion; and a driving means for turning the third and fourth helical members of the toner cartridge stirring means to thereby stir the toner in the toner cartridge and convey the toner in a direction parallel to the axis of said developing roller and toward the opposite ends of the toner cartridge.

19. A developing device which includes a developing member for supplying toner to an electrostatic latent image on a photoconductor drum and developing said latent image, said developing member including a developing roller having an axis extending in a direction parallel to an axis of said photoconductor drum, comprising:

a toner hopper for collecting toner therein and supplying said toner to the developing member, said toner hopper having a central portion; and a stirring member disposed in the toner hopper, said stirring member including a shaft having first and second opposite ends and a central portion therebetween; and first and second helical members wound around said shaft in opposite directions, said first helical member being positioned between the first end and the central portion of said shaft, and said second helical member being positioned between the second end and the central portion of said shaft, each of said helical members having a first coil-shaped portion of predetermined diameter and pitch positioned at an end side portion adjacent the first end of said shaft and a second coil-shaped portion of predetermined diameter and pitch positioned at a central side portion adjacent the central portion of said shaft, said first and second helical members being rotated by said shaft to stir a part of the toner and convey said part of the toner in a direction parallel to the axis of said developing roller and toward the central portion of said hopper, the diameter and pitch of said helical coils determining the speed with which said toner is conveyed to the central portion of said toner hopper portion.

20. A developing device which includes a developing member for supplying toner to an electrostatic latent image on a photoconductor drum and developing said latent image, said developing device comprising:

a toner hopper for collecting toner therein and supplying said toner to the developing member, said toner hopper having a central portion; and a stirring member disposed in the toner hopper, said stirring member including a shaft having first and second opposite ends and a central portion therebetween; and first and second helical members wound around said shaft in opposite directions, said first helical member being positioned between the first end and the central portion of said shaft, and said second helical member being positioned between the second end and the central portion of said shaft, each of said helical members having a first coil-shaped portion of predetermined diameter and pitch positioned at an end side portion adjacent the first end of said shaft and a second coil-shaped portion of predetermined diameter and pitch positioned at a central side portion adjacent the central portion of said shaft, said first and second helical members being rotated by said shaft to stir a part of the toner and convey said part of the toner toward the central portion of said hopper, the diameter and pitch of said helical coils determining the speed with which said toner is conveyed to the central portion of said toner hopper portion, each of said first and second helical members further comprising a toner conveying speed portion located between said first and second coil-shaped portions, said toner conveying speed varying portion being closely wound around said shaft and having a diameter which is less than that of said first and second helical coils.

21. A developing device according to claim 20 wherein the pitch of the second coil-shaped portion of each of said first and second helical members is less than that of said first coil-shaped portion.

22. A developing device which includes a developing member for supplying toner to an electrostatic latent image on a photoconductor drum and developing said latent image, said developing device comprising:

a toner hopper for collecting toner therein and supplying said toner to the developing member, said toner hopper having a central portion; and a stirring member disposed in the toner hopper, said stirring member including a shaft having first and second opposite ends and a central portion therebetween; and first and second helical members wound around said shaft in opposite directions, said first helical member being positioned between the first end and the central portion of said shaft, and said second helical member being positioned between the second end and the central portion of said shaft, each of said helical members having a first coil-shaped portion of predetermined diameter and pitch positioned at an end side portion adjacent the first end of said shaft and a second coil-shaped portion of predetermined diameter and pitch positioned at a central side portion adjacent the central portion of said shaft, said first and second helical members being rotated by said shaft to stir a part of the toner and convey said part of the toner toward the central portion of said hopper, the diameter and pitch of said helical coils determining the speed with which said toner is conveyed to the central portion of said toner hopper portion, the pitch of the second coil-shaped portion of each of said first and second helical members being less than that of said first coil-shaped portion.

23. A developing device which includes a developing member for supplying toner to an electrostatic latent image on a photoconductor drum and developing said latent image, said developing device comprising:

a toner hopper for collecting toner therein and supplying said toner to the developing member, said toner hopper having a central portion; and a stirring member disposed in the toner hopper, said stirring member including a shaft having first and second opposite ends and a central portion therebetween; and first and second helical members wound around said shaft in opposite directions, said first helical member being positioned between the first end and the central portion of said shaft, and said second helical member being positioned between the second end and the central portion of said shaft, each of said helical members having a first coil-shaped portion of predetermined diameter and pitch positioned at an end side portion adjacent the first end of said shaft and a second coil-shaped portion of predetermined diameter and pitch positioned at a central side portion adjacent the central portion of said shaft, said first and second helical members being rotated by said shaft to stir a part of the toner and convey said part of the toner toward the central portion of said hopper, the diameter and pitch of said helical coils determining the speed with which said toner is conveyed to the central portion of said toner hopper portion, the diameter of said first helical member gradually decreasing from the portion thereof adjacent the first end of said shaft to the portion thereof adjacent the central portion of said shaft, and the diameter of said second helical member gradually decreasing from the portion thereof adjacent the second end of said shaft to the portion thereof adjacent the central portion of said shaft.

24. A developing device according to claim 23 wherein the pitch of each of said first and second helical member is constant.

25. A developing device which includes a developing member for supplying toner to an electrostatic latent image on a photoconductor drum and developing said latent image, said developing device comprising:

a toner hopper for collecting toner therein and supplying said toner to the developing member, said toner hopper having a central portion; and a stirring member disposed in the toner hopper, said stirring member including a shaft having first and second opposite ends and a central portion therebetween; and first and second helical members wound around said shaft in opposite directions, said first helical member being positioned between the first end and the central portion of said shaft, and said second helical member being positioned between the second end and the central portion of said shaft, each of said helical members having a first coil-shaped portion of predetermined diameter and pitch positioned at an end side portion adjacent the first end of said shaft and a second coil-shaped portion of predetermined diameter and pitch positioned at a central side portion adjacent the central portion of said shaft, said first and second helical members being rotated by said shaft to stir a part of the toner and convey said part of the toner toward the central portion of said hopper, the diameter and pitch of said helical coils determining the speed with which said toner is conveyed to the central portion of said toner hopper portion, the pitch of said first helical member gradually decreasing from the portion thereof adjacent the first end of said shaft to the portion thereof adjacent the central portion of said shaft, and the pitch of said second helical member gradually decreasing from the portion thereof adjacent the second end of said shaft to the portion thereof adjacent the central portion of said shaft.

26. A developing device according to claim 25 wherein the diameter of each of said first and second helical member is constant.

* * * * *